US009963816B2

(12) United States Patent
Kim et al.

(10) Patent No.: US 9,963,816 B2
(45) **Date of Patent: *May 8, 2018**

(54) CLOTHES TREATING APPARATUS AND METHOD FOR MANUFACTURING A CLOTHES TREATING APPARATUS

(71) Applicant: LG ELECTRONICS INC., Seoul (KR)

(72) Inventors: Jinwoong Kim, Seoul (KR); Hyunseok Seo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 390 days.

This patent is subject to a terminal disclaimer.

(21) Appl. No.: 14/601,346

(22) Filed: Jan. 21, 2015

(65) Prior Publication Data

US 2015/0204002 A1 Jul. 23, 2015

(30) Foreign Application Priority Data

Jan. 21, 2014 (KR) ..... 10-2014-0007395

(51) Int. Cl.
*D06F 37/22* (2006.01)
*D06F 37/26* (2006.01)

(52) U.S. Cl.
CPC ..... *D06F 37/22* (2013.01); *D06F 37/268* (2013.01); *D06F 37/269* (2013.01); *Y10T 29/49826* (2015.01)

(58) Field of Classification Search
CPC ..... D06F 37/22; D06F 37/268; D06F 37/269
(Continued)

(56) References Cited

U.S. PATENT DOCUMENTS 5,570,597 A * 11/1996 Bongini ..... D06F 37/22 68/139
6,557,383 B1 * 5/2003 Ito ..... D06F 37/04 68/140

(Continued)

FOREIGN PATENT DOCUMENTS

CN 101046046 10/2007
CN 101294344 10/2008

(Continued)

OTHER PUBLICATIONS

European Search Report issued in Application No. 15151710.9 dated May 20, 2015.

(Continued)

*Primary Examiner* — Joseph L. Perrin
*Assistant Examiner* — Kevin G Lee
(74) *Attorney, Agent, or Firm* — KED & Associates, LLP

(57) ABSTRACT

A clothes treating apparatus and a method for manufacturing a clothes treating apparatus are provided. The clothes treating apparatus may include a cabinet, a tub disposed in the cabinet, a drum rotatably accommodated in the tub, a support having a first side connected to a rear side of the tub and a second side that extends in a downward direction and then is bent in a upward direction, a damper having a lower end connected to a bottom surface of the cabinet, and a damper holder installed between the damper and the support, and configured to connect the damper to the support. The support may be disposed such that a height of a lowest end thereof is lower than a height of a coupling shaft of the damper coupled to the damper holder. With such a configuration, the damper may be easily coupled to the support regardless of a position of the lowest end of the support.

8 Claims, 14 Drawing Sheets

(58) Field of Classification Search
USPC ..... 68/23.1, 12.06
See application file for complete search history.

(56) References Cited

U.S. PATENT DOCUMENTS

| | | | | |
|---|---|---|---|---|
| 7,536,882 | B2 * | 5/2009 | Kim | D06F 37/22 68/140 |
| 2005/0005650 | A1 | 1/2005 | Kim et al. | |
| 2007/0289339 | A1 * | 12/2007 | Lim | D06F 37/20 68/23.1 |
| 2008/0264114 | A1 | 10/2008 | Jang et al. | |
| 2012/0006067 | A1 | 1/2012 | Lim et al. | |
| 2012/0024019 | A1 | 2/2012 | Song et al. | |
| 2012/0104912 | A1 | 5/2012 | Song et al. | |

FOREIGN PATENT DOCUMENTS

| | | | |
|---|---|---|---|
| CN | 102301058 | | 12/2011 |
| CN | 102439213 | | 5/2012 |
| CN | 104294538 | | 1/2015 |
| EP | 0504619 | A1 | 9/1992 |
| EP | 1 201 810 | | 1/2005 |
| EP | 1 760 183 | A2 | 3/2007 |
| EP | 2 280 111 | | 2/2011 |

OTHER PUBLICATIONS

Chinese Office Action dated May 31, 2016 issued in Application No. 201510030166.2 (with English Translation).
Chinese Office Action dated Feb. 4, 2017 (English translation).

* cited by examiner

CLOTHES TREATING APPARATUS AND METHOD FOR MANUFACTURING A CLOTHES TREATING APPARATUS

CROSS-REFERENCE TO RELATED APPLICATION(S)

Pursuant to 35 U.S.C. § 119(a), this application claims priority to Korean Application No. 10-2014-0007395, filed in Korea on Jan. 21, 2014, the contents of which is incorporated by reference herein in its entirety.

BACKGROUND

1. Field

A clothes treating apparatus and a method for manufacturing a clothes treating apparatus are disclosed herein.

2. Background

Generally, a clothes treating apparatus, such as a washing machine, a washing machine having a drying function, or a dryer, may include a drum into which laundry may be introduced. In a case of a washing machine, a tub to accommodate washing water may further be provided, and a drum may be rotatably installed in the tub.

FIG. 1 is a side sectional view of a washing machine, as an example of a clothes treating apparatus, in accordance with the related art. As shown, the washing machine of FIG. 1 includes a cabinet 11, a tub 21 accommodated in the cabinet 11, and a drum 31 rotatably installed in the tub 21.

An opening 12 and a door 13, through which laundry may be introduced into the washing machine, are provided on a front surface of the cabinet 11. The tub 21 is supported in the cabinet 11 by a spring 22 and a damper 23. The tub 21 has a cylindrical shape, one side of which is open, and the drum 31 is rotatably installed in the tub 21.

The drum 31 has a cylindrical shape, a front side of which is open, and a plurality of through holes 33 is formed on a circumferential surface of the drum 31. A plurality of lifts 35 to lift laundry is provided on an inner surface of the drum 31.

A drive motor 25 to rotate the drum 31 is coupled to a rear side of the tub 21. A drain passage 27 having a drain pump 28 to discharge water is provided at a bottom surface of the drum 31.

A detergent input device 41 to supply detergent is provided above the tub 21. The detergent input device 41 is connected to a water supply pipe 43. The water supply pipe 43 is provided with a water supply valve 45.

In the conventional clothes treating apparatus discussed above, vibration generated when the drum 31 is rotated by the drive motor 25 is transmitted to the tub 21. In order to absorb the vibration transmitted to the tub 21, the spring 22 and the damper 23 are provided. Further, an additional buffering member to absorb vibration of the drum is required. As the buffering member is connected to the drum 31 or the tub 21, an installation space of the buffering member is large. This may limit a size of the drum or the tub.

BRIEF DESCRIPTION OF THE DRAWINGS

Embodiments will be described in detail with reference to the following drawings in which like reference numerals refer to like elements, and wherein.

DETAILED DESCRIPTION

Figure 1:
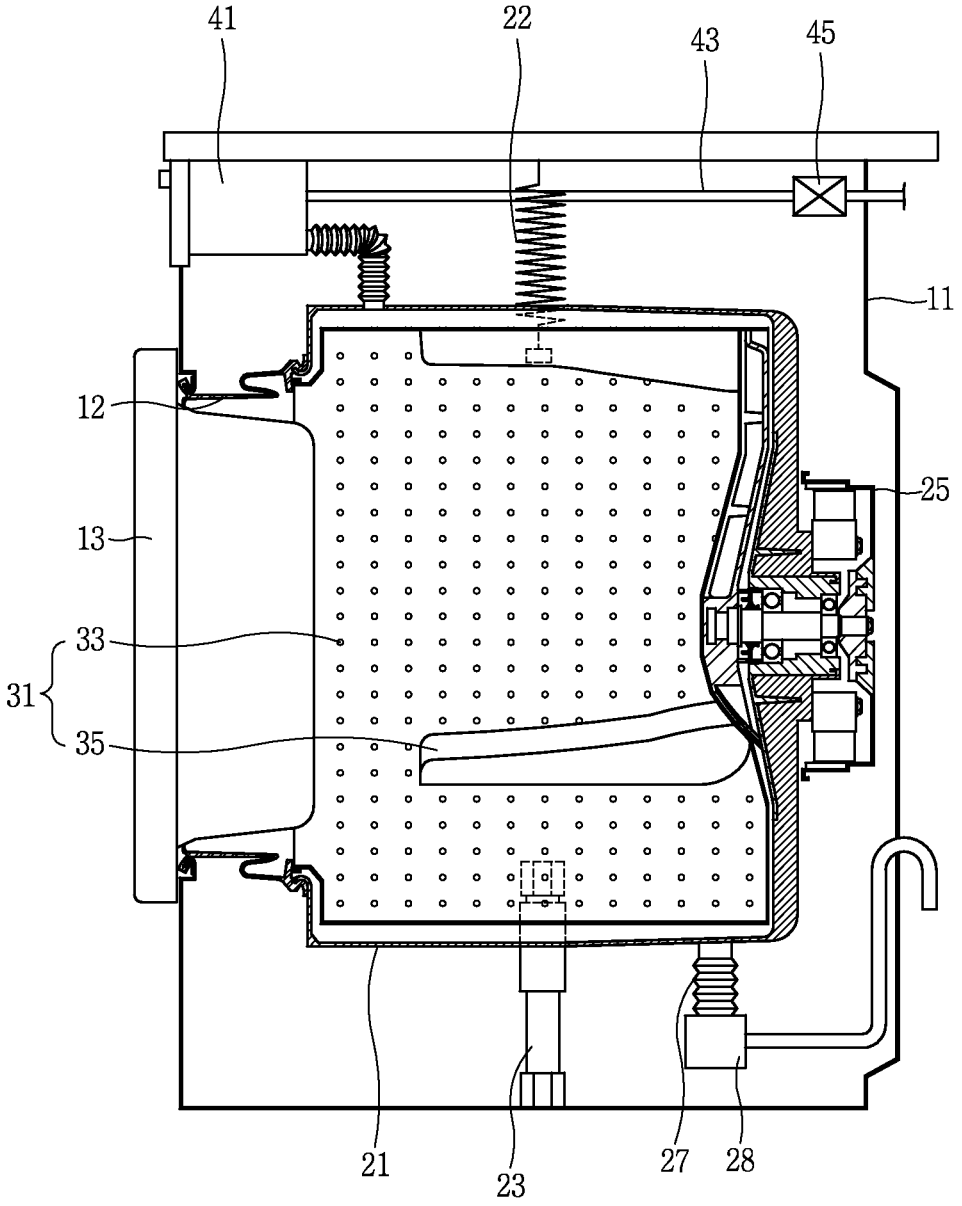
FIG. 1 RELATED ART
FIG. 1 is a side sectional view of a washing machine in accordance with the conventional art.

Description will now be given in detail of embodiments, with reference to the accompanying drawings. Where possible, like reference numerals have been used to indicate like elements, and repetitive disclosure has been omitted.

Embodiments shown in the attached drawings are related to a washing machine for washing and drying clothes. However, embodiments are not limited to this, but rather, are applicable to a clothes treating apparatus that generates vibration as a drum is rotated, for example, a dryer, a washing machine, or other similar apparatus.

Figure 2:
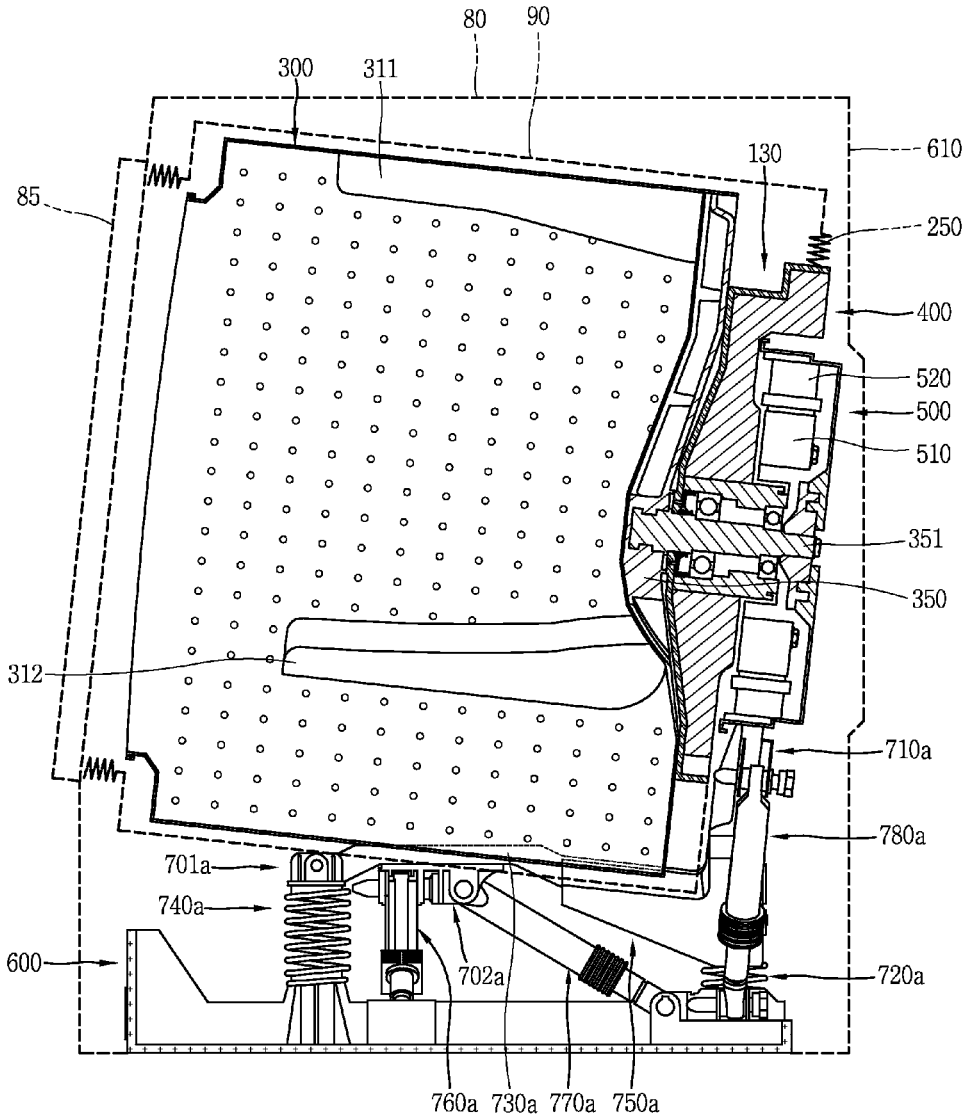
FIG. 2 is a partial side sectional view of a clothes treating apparatus according to an embodiment.

A clothes treating apparatus according to an embodiment may be implemented as a washing machine. As shown in FIG. 2, the clothes treating apparatus may include a cabinet 80, which may form an accommodation space therein, a tub 90 accommodated in the cabinet 80, and a drum 300 rotatably accommodated in the tub 90.

The cabinet 80 may be provided with an inlet, through which laundry may be introduced into the clothes treating apparatus, on a front surface thereof. The cabinet 80 may be further provided with a door 85 to open and close the inlet, on a front surface thereof.

Although not shown, the tub 90 may be supported in the cabinet 80 in a suspended manner (refer to FIG. 1). The tub 90 may have an inlet, through which laundry may be introduced into the clothes treating apparatus, at a front side thereof, and may form a space to store washing water used to wash laundry. One side of the tub 90 may be fixed to a base 600 of the cabinet 80.

Figure 3:
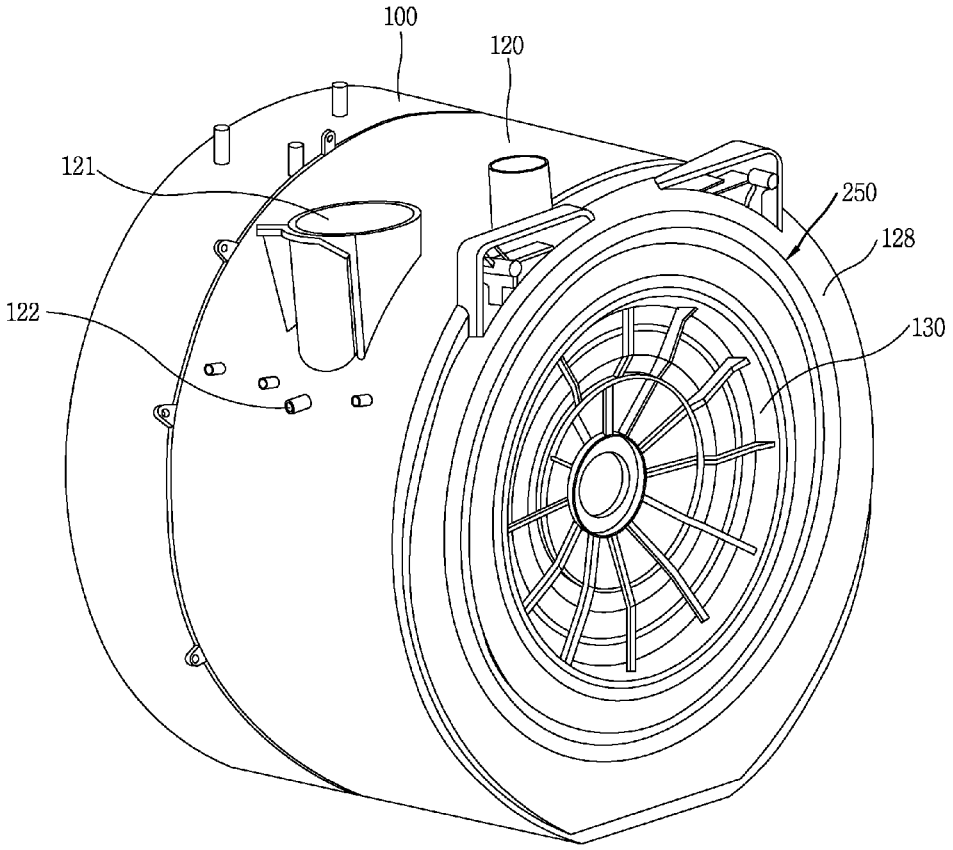
FIG. 3 is a perspective view of a tub and a rear gasket of the clothes treating apparatus of FIG. 2.

As shown in FIG. 3, the tub 90 may include a tub front 100, which may form a front side of the tub 90, and a tub rear 120, which may form a rear side of the tub 90. The tub front 100 and the tub rear 120 may be assembled to each other by, for example, screws, and form a space to accommodate the drum 300 therein. The tub rear 120 may have a cylindrical shape to enclose the drum 300. A front side of the tub rear 120 may be open, and a rear side of the tub rear 120 may have a doughnut-shaped rear surface 128. The front side of the tub rear 120 may be coupled to the tub front 100 in a sealed manner.

The tub rear 120 may be provided with a blast outlet 121 for a washing machine for both washing and drying. The tub rear 120 may also be provided with a cooling water injection opening 122, through which cooling water may be supplied to an inside of the tub 90. In another embodiment, a clothes treating apparatus having only a washing function may not be provided with the blast outlet 121 and the cooling water injection opening 122.

A plurality of coupling portions to be fixedly-installed at or to the cabinet 80 may be formed at the tub rear 120. Further, an inner circumference of the rear surface 128 of the tub rear 120 may be connected to an outer circumference of a rear gasket 250. An inner circumference of the rear gasket 250 may be connected to a tub back 130. The tub back 130 may be provided with a through hole at a central portion thereof, through which a rotational shaft 351 may be passed. The rear gasket 250 may be formed of a flexible material, such that vibration of the tub back 130 may not be transmitted to the tub rear 120.

The rear gasket 250 may be connected to the tub back 130 and the tub rear 120 in a sealed manner, thereby preventing washing water in the tub 90 from leaking to the outside. When the drum 300 is rotated, the tub back 130 may vibrate together with the drum 300. The drum 300 may be spaced from the tub rear 120 with a predetermined or sufficient gap therebetween, to prevent interference with the tub rear 120. As set forth above, the rear gasket 250 may be formed of a flexible material, such that the tub back 130 performs a relative motion with respect to the tub rear 120 without interference therebetween. The rear gasket 250 may include a bellows portion, which may extend a predetermined or sufficient length so that the tub back 130 may perform the relative motion with respect to the tub rear 120.

The drum 300 may be accommodated in the tub 90, and may be rotatably coupled to a rear side of the tub 90. A plurality of through holes may be provided at a circumference and a rear end of the drum 300, such that an inside and an outside of the drum 300 communicate with each other.

A spider 350 may be provided at a rear end of the drum 300. The spider 350 may be arranged to extend in a radial direction of the drum 300.

A plurality of lifters 311, 312 may be provided on an inner surface of a circumference (cylindrical portion) of the drum 300, such that laundry may be lifted up when the drum 300 is rotated. The drum 300 may further be provided with ball balancers at a front side and a rear side thereof. The rear side of the drum 300 may be connected to the spider 350, and the spider 350 may be connected to the rotational shaft 351. The drum 300 may be rotated in the tub 90 by a rotational force transmitted through the rotational shaft 351.

The rotational shaft 351 may be directly connected to a drive motor 500 through the tub back 130. More specifically, a rotor 520 of the drive motor 500 may be directly connected to the rotational shaft 351. A bearing housing 400 may be coupled to a rear surface of the tub back 130. The bearing housing 400 may rotatably support the rotational shaft 351 between the drive motor 500 and the tub back 130.

A stator 510 of the drive motor 500 may be fixedly-installed at the bearing housing 400. The rotor 520 may be disposed to enclose the stator 510. The drive motor 500 may be an outer rotor type of motor, and may be directly connected to the rotational shaft 351.

Figure 4:
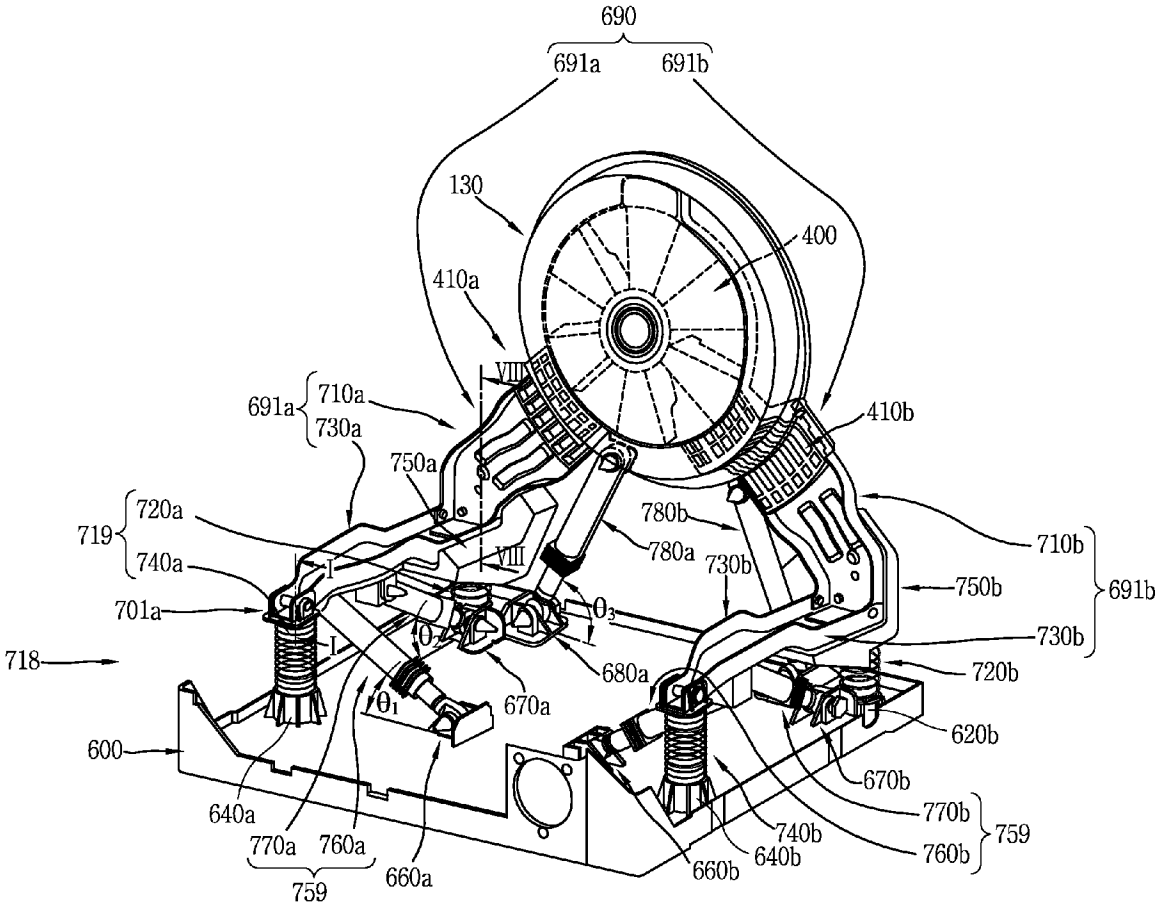
FIG. 4 is a perspective view of a bearing housing coupled to a tub back of the clothes treating apparatus of FIG. 2, installed on a lower surface of a cabinet, by a plurality of supports, a plurality of dampers, and a plurality of elastic members.

The bearing housing 400 may be supported with respect to the base 600, which may form a bottom surface of the cabinet 80, by a suspension. As shown in FIG. 4, the suspension may include a plurality of supports 690 connected to the bearing housing 400, and a damping member 718 installed between each support 690 and the base 600. The plurality of supports 690 may include a first support 691*a* and a second support 691*b* disposed, respectively, at two lower portions with respect to the drum 300. Each damping member 718 may include a damper 759 and an elastic member 719, each disposed between the respective support 690 and the base 600.

The suspension may be disposed such that the supports 690, the dampers 759, and the elastic members 719 are symmetrical to each other, based on the rotational shaft 351 of the drum 300. According to one embodiment, the suspension may further include masses installed at each support 690. The masses may be disposed to be symmetrical to each other, based on the rotational shaft 351 of the drum 300.

Hereinafter, components installed at a left side of the drawings will be explained.

The support 690 (the first support 691*a* disposed on the left side of the drawings) may be connected to the bearing housing 400, and may be connected to the tub back 130 at a rear side of the tub 90 by the bearing housing 400. The support 690 may extend toward the base 600 at the rear side of the tub 90, and extend toward a side of the cabinet 80 so as to be inclined with respect to the base 600. The support 690 may extend in a downward direction and then be bent between the tub 90 and the base 600, and continuously extend toward a front side of the cabinet 80.

A bent portion, formed as the support 690 passes through a space between the rear side of the tub 90 and the cabinet 80 and is bent, may be a lowest portion of the support 690. That is, the support 690 may be formed such that a distance from the base 600 is shortest at the bent portion. Further, the support 690 may extend from the bent portion toward the front side of the cabinet 80. In this case, the support 690 may extend toward an upper side of the tub 90 a little such that a distance from the base 600 gradually increases. As the lowest portion of the support 690 is formed at a rear side of the cabinet 80, the bearing housing 400 and the drum 300 may be stably supported. The support 690 may extend in the upward direction a little toward the front side of the cabinet 80. Further, a front side of the support 690 may be bent in an approximate arch shape, such that a space to mount a damper holder may be formed.

As indicated above, a plurality of the supports 690 may be provided. Alternatively, only one support 690 may be provided. In the case where the plurality of the supports 690 is provided, the first support 691*a* may be disposed on the left or a first side and the second support 691*b* may be disposed on the right or a second side, with shapes symmetrical to each other, based on the rotational shaft 351 of the drum 300. The plurality of supports 690 may include first brackets 710*a*, 710*b* and second brackets 730*a*, 730*b*. The first support 691*a* and the second support 691*b* may have shapes symmetrical to each other. Hereinafter, the support 691*a* disposed on the left or the first side based on the rotational shaft 351 of the drum 300 will be explained.

The first bracket 710*a* may be connected to a bracket connection portion 410*a* of the bearing housing 400, and may extend toward the base 600 with an inclination at a rear side of the tub back 130 and be bent between the tub 100 and the base 600. The first bracket 710*a* may be formed such that a width thereof is narrower toward a lower side from an upper side. That is, the first bracket 710*a* connected to the bracket connection portion 410*a* may have an upper side width greater than a lower side width.

The first bracket 710*a* may be coupled to the bracket connection portion 410*a* of the bearing housing 400, utilizing a plurality of coupling holes formed at an upper portion of the first bracket 710*a*. A damper coupling portion 714, to which a third damper 780*a*, which is explained hereinbelow, may be hinge-coupled, may be further formed at an upper side of the first bracket 710*a*. In a case in which no third damper is provided, the damper coupling portion 714 may be omitted. The damper coupling portion 714 may be formed as one or more protrusion having one or more hinge coupling hole that protrudes toward a side at an upper right side of the first bracket 710*a*.

Bent portion 713, a lower portion of the first bracket 710*a*, may be connected to a second bracket 730*a*, which is explained hereinbelow, and may be connected to an elastic member. In a case in which a suspension according to an embodiment further includes mass 750*a*, the mass 750*a* may be provided between the bent portion 713 and the elastic member. The bent portion 713 may be provided with four or more through holes for caulking, for example.

The first bracket 710*a* may further include side walls 711 and 712 formed to obtain intensity or increase a strength of the first bracket 710*a*, in order to stably support the drum 300 without downward deformation, and beads 715. The side walls 711 and 712, which may be disposed at two ends or side of the first bracket 710*a* in a widthwise direction, may be formed so that a height thereof increase toward a lower side from an upper side. The beads 715 may be formed between an upper portion of the first bracket 710*a* and the bent portion 713. For example, two beads 715 may extend in an extended direction of the first bracket 710*a* substantially in parallel. However, a shape of the beads is not limited to that shown, and any shape which can satisfy a required intensity or strength may be implemented.

The first bracket 710*a* may be provided with the side walls 711, 712 and the beads 715, as it is formed by, for example, press-molding. The second bracket 730*a*, which is explained hereinbelow, may also be formed by, for example, press-molding, and may be formed of a same material as the first bracket 710*a*.

The second bracket 730*a* may be disposed below the tub 90, and may extend from the first bracket 710*a* toward the front side of the cabinet 80, along the space between the tub 90 and the base 600. The second bracket 730*a* may be formed so as to extend toward the upper side of the tub 90 a little, from a rear end portion to a middle portion thereof. The second bracket 730*a* may be formed so as to be bent in an approximate arch shape, from the middle portion to a front end portion. A damper holder mounting portion may be formed at a lower surface of the second bracket 730*a*.

The second bracket 730*a* may be formed such that a width thereof is narrowed toward a front side from a rear side thereof. That is, the rear end portion of the second bracket 730*a*, connected to the first bracket 710*a*, may have a width greater than a width of the front end portion of the second bracket 730*a*.

The rear end portion of the second bracket 730*a* may be connected to the bent portion 713 of the first bracket 710*a* in a caulking manner, for example, and may be caulked on or at least 4 connection points. However, the coupling method is not limited to this. That is, the second bracket 730*a* may be coupled to the first bracket 710*a* by a coupling method, such as bolts, and an additional coupling means or method may be used in addition to the caulking method.

The front end portion of the second bracket 730*a* may be elastically supported by a front elastic member 740*a*, and the middle portion of the second bracket 730*a* may be supported by a second damper 770*a*. A space between the front end portion and the middle portion of the second bracket 730*a* may be supported by a first damper 760*a*, and the rear end portion of the second bracket 730*a* may be elastically supported by a rear elastic member 720*a*.

A front spring holder 701*a* to connect the front elastic member 740*a* to the second bracket 730*a*, a damper holder 702*a* to connect the first damper 760*a* and the second damper 770*a* to the second bracket 730*a*, and a rear spring holder 703*a* to connect the rear elastic member 720*a* to the second bracket 730*a* may be further provided. The second bracket 730*a* may be coupled to the front spring holder 701*a* by, for example, a bolt 820*a*, as a coupling hole may be formed at or in a side wall of the front end portion of the second bracket 730*a*. The second bracket 730*a* may be coupled to the damper holder 702*a* by, for example, one or more coupling screw 830*a*, as one or more coupling hole may be penetratingly formed at or in a damper holder mounting portion 734. The rear spring holder 703*a* may be coupled to a lower portion of the bent portion of the first support 691*a*. However, in a case in which the mass 750*a* is installed at the bent portion of the first support 691*a* as discussed hereinbelow, the rear spring holder 703*a* may be coupled to a lower surface of the mass 750*a*.

Figure 5:
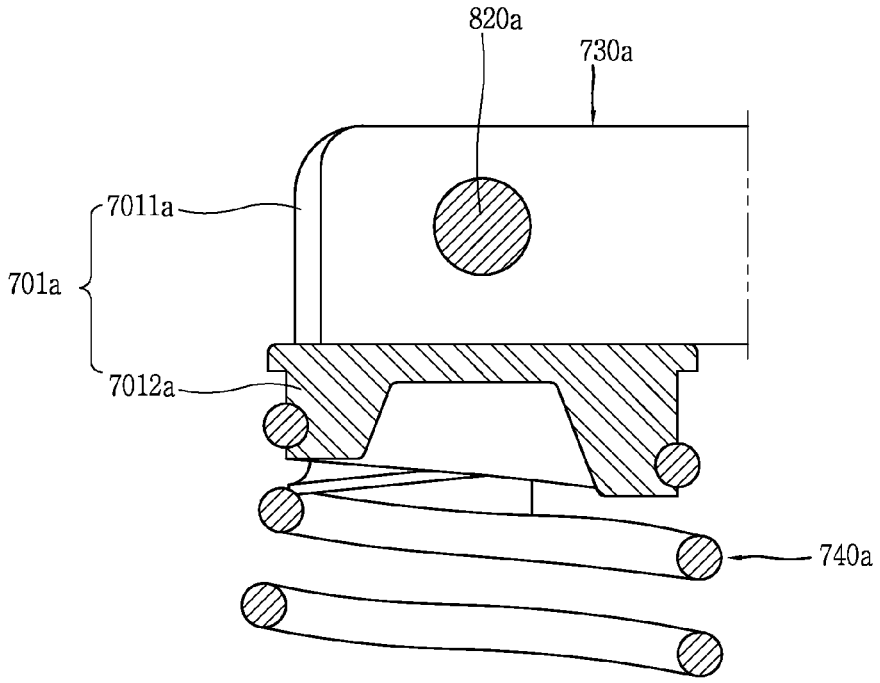
FIG. 5 is a side sectional view, taken above line V-V of FIG. 4.

As shown in FIG. 5, the front spring holder 701*a* may include an upper portion 7011*a* coupled to the front end portion of the second bracket 730*a* by the bolt 820*a*, and a lower portion 7012*a*, to which the front elastic member 740*a* may be fittedly-coupled. The upper portion 7011*a* of the front spring holder 701*a* may have a 'U' shape that contacts a lower surface and two side wall surfaces of the front end portion of the second bracket 730*a*. The lower portion 7012*a* of the front spring holder 701*a* may have an approximate cylindrical shape, and a hole may be formed at or in the lower portion 7012*a*.

The lower portion 7012*a* of the front spring holder 701*a* may be provided with a screw thread on an outer surface thereof, and the front elastic member 740*a* may be fittedly-coupled to the screw thread. A stopper may protrude from an end of the screw thread, thereby blocking an end portion of the front elastic member 740*a*.

A pair of elastic members may be configured to elastically support two ends of the second bracket 730*a*, and may include the front elastic member 740*a* and the rear elastic member 720*a*. The front elastic member 740*a* and the rear elastic member 720*a* may be springs, and may extend in a vertical direction with respect to the base 600. The springs used as the elastic members 740*a*, 720*a* may have a side silhouette of a bell shape or a jar shape. For instance, the spring used as the elastic member may be formed such that its diameter is small at an end portion thereof coupled to the lower portion 7012*a* of the front spring holder 701*a*, and its diameter gradually increases toward the base 600.

With the above configuration, the diameter of the elastic member gradually increases toward the base 600. Accordingly, even if the elastic member 740*a* is transformed by vibration generated when the drum 300 is rotated, the lower portion 7012*a* of the front spring holder 701*a* does not collide with the spring. This may prevent noise.

As shown in FIG. 4, such elastic members may be provided at lateral sides based on the rotational shaft 351 of the drum 300. The elastic members may be configured to elastically support the drum 300 and components connected to the drum 300, at 4 points, for example. More specifically, two front elastic members 740*a*, 740*b* may be provided at first and second lateral sides, and two rear elastic members 720*a*, 720*b* may be provided at first and second lateral sides. Elastic member fixing portions 620*a*, 620*b*, 640*a*, 640*b* to fix the elastic members 720*a*, 720*b*, 740*a*, 740*b* may protrude from the base 600, thereby fixing the elastic members 720*a*, 720*b*, 740*a*, 740*b* to the base 600.

A plurality of damper fixing portions to hinge-couple a plurality of dampers to the base 600 may be provided at the base 600. The plurality of damper fixing portions may include first damper fixing portions 660*a*, 660*b*, second damper fixing portions 670*a*, 670*b*, and third damper fixing portions.

The first damper fixing portions 660*a*, 660*b* to fix first dampers 760*a*, 760*b* to the base 600 may extend upward from the base 600, and may be provided with coupling holes penetratingly-formed in the rear to front direction of the cabinet 80. Further, the first damper fixing portions 660*a*, 660*b* may be further provided with plates to fix end portions of the first dampers 760*a*, 760*b* to the base 600, without being pushed toward an inner side of the cabinet 80. The first dampers 760*a*, 760*b* may be fixed to the base 600, by, for example, pins that pass through the coupling holes of the first damper fixing portions 660*a*, 660*b*.

The second damper fixing portions 670*a*, 670*b* to fix second dampers 770*a*, 770*b* to the base 600 may extend upward from the base 600, and may be provided with coupling holes penetratingly-formed in the lateral direction of the cabinet 80. Further, the second damper fixing portions 670*a*, 670*b* may be further provided with plates to fix end portions of the second dampers 770*a*, 770*b* to the base 600, without being pushed toward a rear side of the cabinet 80. The second dampers 770*a*, 770*b* may be fixed to the base 600, by, for example, pins that pass through the coupling holes of the second damper fixing portions 670*a*, 670*b*.

The third damper fixing portions to fix third dampers 780*a*, 780*b* to the base 600 may extend upward from the base 600, and may be provided with coupling holes penetratingly-formed in the rear to front direction of the cabinet 80. Further, the third damper fixing portions may be further provided with plates to fix end portions of the third dampers 780*a*, 780*b* to the base 600, without being pushed toward a lateral side of the cabinet 80. In the drawings, only the left third damper fixing portion 680*a* is illustrated. However, the right third damper fixing portion may be also formed, as a pair of third dampers 780*a*, 780*b* may be installed right and left in a symmetrical manner. In this case, the third damper fixing portions may be formed at the base 600 when the third dampers 780*a*, 780*b* are further provided according to an embodiment.

As discussed above, the rear end portion of the second bracket 730*a* may be coupled to the first bracket 710*a*, and the rear elastic member 720*a* may be provided between the rear end portion of the second bracket 730*a* and the base 600 to thus be elastically-supported. In a case in which the mass 750*a* is further provided according to an embodiment, the mass 750*a* may be coupled to a lower portion of the second bracket 730*a*. The rear elastic member 720*a* may be provided between the mass 750*a* and the base 600, thereby elastically-supporting the first bracket 710*a*, the second bracket 730*a*, and the mass 750*a*.

The second bracket 730*a* may further include side walls 731 and 732 formed to obtain intensity or increase a strength of second bracket 730*a*, in order to stably support the drum 300, and beads 735. The side walls 731 and 732 may be disposed at two ends of the second bracket 730*a* in a widthwise direction. The second bracket 730*a* may be formed such that its width gradually increases toward a rear end from a front end thereof. The beads 735 may be formed between the front end and the rear end of the second bracket 730*a*, and may extend in an extended direction of the second bracket 730*a*. The second bracket 730*a* may be further provided with the damper holder mounting portion 734 to couple the damper holder 702*a*, at a lower surface thereof. The damper holder mounting portion 734 may be a space to connect the damper holder 702*a* to a lower side of the second bracket 730*a*, and may be formed as an upper surface of the second bracket 730*a* from the front end portion to the middle portion is bent in an arch shape.

Figure 6:
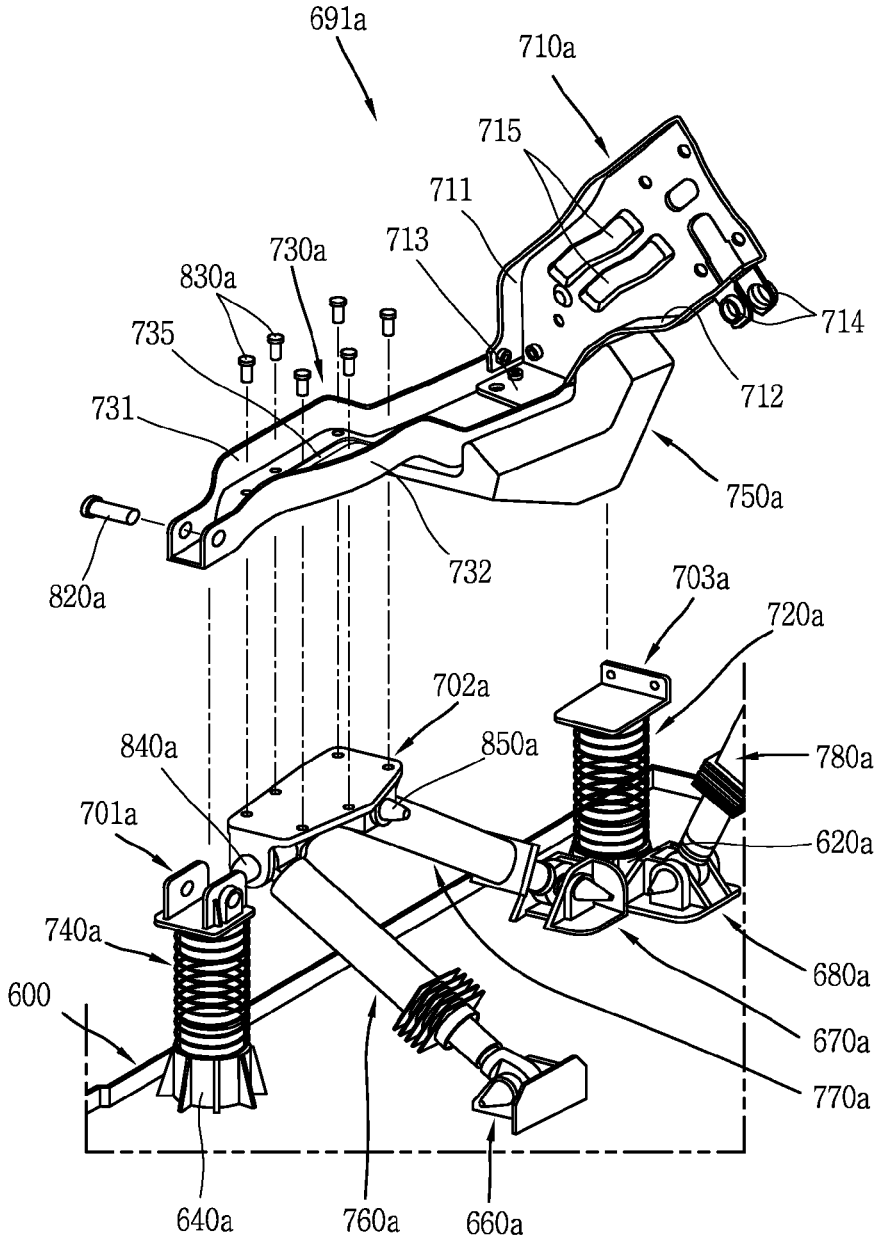
FIG. 6 is a partial disassembled perspective view of FIG. 4, which illustrates a damper holder, to which a first damper and a second damper have been coupled, coupled to a support.
Figure 7:
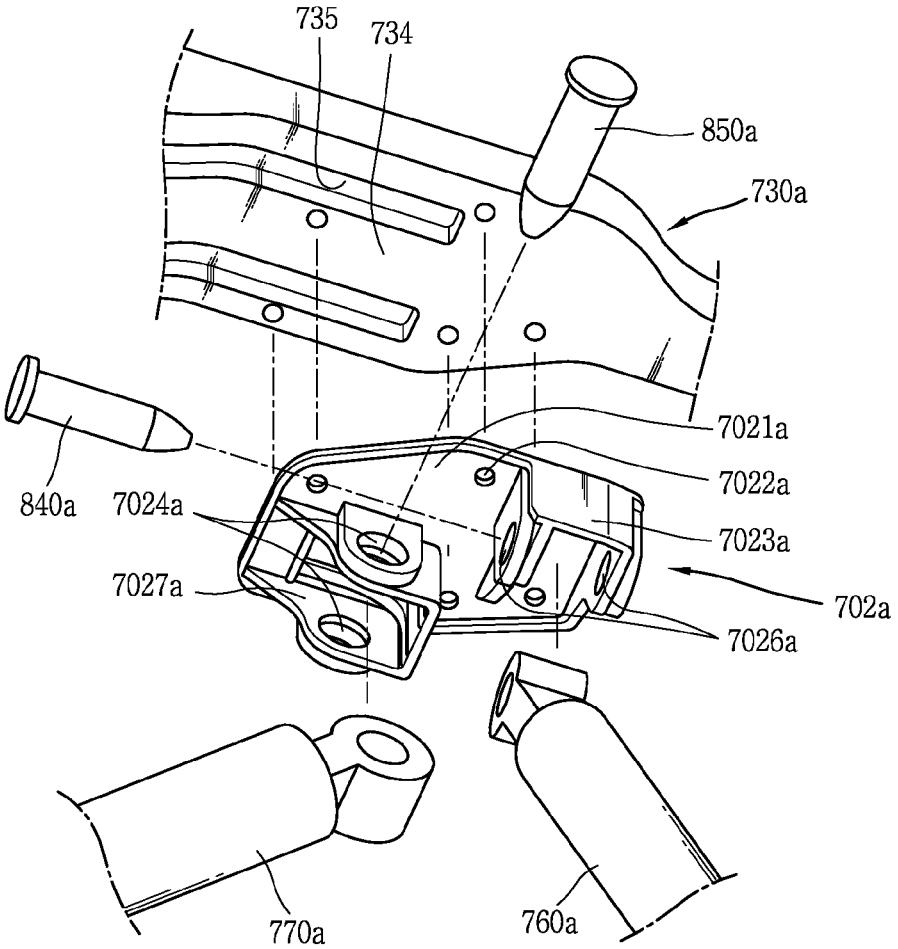
FIG. 7 is a bottom perspective view of the first damper and the second damper of FIG. 4 coupled to the damper holder.

The first damper 760*a* and the second damper 770*a* may be connected to the second bracket 730*a* by the damper holder 702*a*. As shown in FIGS. 6 and 7, the damper holder 702*a* may be coupled to the damper holder mounting portion 734 by, for example, the coupling screws 830*a* formed to penetrate from an upper surface of the second bracket 730*a* to the damper holder mounting portion 734.

The damper holder 702*a* may include a plate 7021*a* installed at the damper holder mounting portion 734, and coupled to the damper holder mounting portion 734 by, for example, screws, a first damper connection portion 7023*a* that protrudes downward from the plate 7021*a*, and may be hinge-coupled to the first damper 760*a*, and a second damper connection portion 7027*a* that protrudes downward from the plate 7021*a*, and may be hinge-coupled to the second damper 770*a*. The plate 7021*a* may have a plate shape having a silhouette that extends from two edges of the damper holder mounting portion 734, and provided with a plurality of through holes 7022*a*. The plate 7021*a* may be coupled to the damper holder mounting portion 734 by, for example, the coupling screws 830*a*. The first damper connection portion 7023*a* and the second damper connection portion 7027*a* may be formed at a lower surface of the plate 7021*a*. The first damper connection portion 7023*a* may be disposed at the front side of the cabinet 80, and may be closer to the lateral side of the cabinet 80 than the second damper connection portion 7027*a*. The second damper connection portion 7027*a* may be disposed at the rear side of the cabinet 80, and may be closer to an inner side of the cabinet 80 than the first damper connection portion 7023*a*. Further, the first damper connection portion 7023*a* and the second damper connection portion 7027*a* may be formed so that the first damper 760*a* and the second damper 770*a* may be arranged at or in the base 600 at angles, as explained hereinbelow.

The first damper connection portion 7023*a* may be a partition open toward an inner side of the cabinet 80 and the base 600. That is, the first damper connection portion 7023*a* may be formed as an approximate 'U'-shaped plate, disposed to face the front side, the lateral side, and the rear side of the cabinet 80, respectively, and may extend from a lower surface of the plate 7021*a*, toward the base 600. The first damper connection portion 7023*a* may be provided with through holes 7026*a* at surfaces that face the front side and the rear side of the cabinet 80. A first damper pin 840*a* may be inserted into the through hole 7026*a* to hinge-couple, the first damper 760*a* to the first damper connection portion

7023*a*. In this case, the first damper 760*a* may be hinge-coupled to the first damper connection portion 7023*a* by the first damper pin 840*a*, such that a coupling shaft of the first damper 760*a* may extend in the rear to front direction of the cabinet 80.

The second damper connection portion 7027*a* may be a partition open toward the rear side of the cabinet 80 and the base 600. That is, the second damper connection portion 7027*a* may be formed as an approximate 'U'-shaped plate, disposed to face the front side, the side surface, and the inner side of the cabinet 80, respectively, and may extend from a lower surface of the plate 7021*a*, toward the base 600. The second damper connection portion 7027*a* may be provided with through holes 7024*a* at surfaces that face the lateral side and the inner side of the cabinet 80. A second damper pin 850*a* may be inserted into the through holes 7024*a*, to hinge-couple the second damper 770*a* to the second damper connection portion 7027*a*. In this case, the second damper 770*a* may be hinge-coupled to the second damper connection portion 7027*a* by the second damper pin 850*a*, such that a coupling shaft of the second damper 770*a* may extend in the lateral direction of the cabinet 80.

As shown, an extended line of a shaft of the first damper pin 840*a* that connects the first damper connection portion 7023*a* and the first damper 760*a* to each other may cross an extended line of a shaft of the second damper pin 850*a* that connects the second damper connection portion 7027*a* and the second damper 770*a* to each other. That is, the first damper connection portion 7023*a* and the second damper connection portion 7027*a* may be arranged so that a central axis of the through holes 7026*a* of the first damper connection portion 7023*a* crosses a central axis of the through holes 7024*a* of the second damper connection portion 7027*a*. Further, one through hole 7024*a* of the second damper connection portion 7027*a* may be arranged close to the central axis of the through holes 7026*a* of the first damper connection portion 7023*a*.

With this configuration, the first damper connection portion 7023*a* and the second damper connection portion 7027*a* may be efficiently arranged in a limited space below the damper holder mounting portion 734. Accordingly, the first damper 760*a* and the second damper 770*a* may be stably connected to the second bracket 730*a*. Further, the first damper connection portion 7023*a* and the second damper connection portion 7027*a* may be stably supported, as they are fixedly-connected to the plate 7021*a*.

The first damper pin 840*a* may be inserted into the through holes 7026*a* of the first damper connection portion 7023*a*, toward the front side from the rear side of the cabinet 80. The second damper pin 850*a* may be inserted into the through holes 7024*a* of the second damper connection portion 7027*a*, toward the inner side from the lateral side of the cabinet 80. In this case, as discussed above, if one through hole 7024*a* of the second damper connection portion 7027*a* is arranged close to the central axis of the through holes 7026*a* of the first damper connection portion 7023*a*, it may be difficult to couple the first damper pin 840*a* to the through holes 7026*a*, because the one through hole 7024*a* of the second damper connection portion 7027*a* may be blocked by a head of the second damper pin 850*a* coupled to the second damper connection portion 7027*b*. Therefore, the first damper pin 840*a* may be coupled first, and then, the second damper pin 850*a*.

However, the coupling order may differ according a shape and an arrangement of the first damper connection portion 7023*a* and the second damper connection portion 7027*a*, a shape and a coupling direction of the first damper pin 840*a* and the second damper pin 850*a*, for example. For instance, unlike the aforementioned configuration, if one through hole 7026*a* of the first damper connection portion 7023*a* is arranged close to the central axis of the through holes 7024*a* of the second damper connection portion 7027*a*, the second damper pin 850*a* may be coupled first, and then, the first damper pin 840*a*. Further, if the first damper pin 840*a* and/or the second damper pin 850*a* are inserted in opposite directions to the directions shown in FIG. 7, the coupling order is not considered. Detailed assembly processes among the plurality of dampers, the damper holder, and the second bracket will be explained hereinbelow.

A shape of the damper holder 702*a* is not limited to the aforementioned shape. For example, the first damper connection portion 7023*a* and the second damper connection portion 7027*a* may be formed as separate members, not as members connected to a single plate, and may be coupled to the second bracket 730*a*, respectively. In this case, when the first damper pin 840*a* and the second damper pin 850*a* are assembled to each other, the first damper connection portion 7023*a* and the second damper connection portion 7027*a* do not interfere with each other.

According to one embodiment, the masses 750*a*, 750*b* may be further included. The mass may be an approximate 'L'-shaped concrete mass, which may extend to toward the front side and the upper side of the cabinet 80. However, the material of the mass is not limited to concrete. That is, the mass may be formed of any material which can provide a weight large enough for the drum 300 to be balanced. The masses 750*a*, 750*b* may be installed on lateral sides based on the rotational shaft 351 of the drum 300, with shapes symmetrical to each other. Hereinafter, the mass 750*a* on the left will be explained.

The mass 750*a* may enclose a connection portion between the first bracket 710*a* and the second bracket 730*a*, and may enclose a rear surface of the first bracket 710*a* and a lower surface of the second bracket 730*a*. The mass 750*a* may be formed such that its surface that contacts the first bracket 710*a* and the second bracket 730*a* is dented, in order to enclose a portion of the right side wall 712 of the first bracket 710*a*, and a portion of the right side wall 732 of the second bracket 730*a*. However, embodiments are not limited thereto; that is, the mass 750*a* may be attached to the first bracket 710*a* or the second bracket 730*a*.

The mass 750*a* may be formed such that the center of gravity is concentrated to or at the rear side of the cabinet 80, or the inner side of the cabinet 80. More specifically, as shown, the mass 750*a* may have a greatest thickness at a portion corresponding to the bent portion of the support, that is, at the portion corresponding to the connection portion of the first bracket 710*a* and the second bracket 730*a*. The thickness may gradually decease toward the front side of the cabinet 80 from a lower surface of the second bracket 730*a*. The mass 750*a* may have a thickness in the lateral direction which may be greater at a portion that enclose the side wall 712 of the second bracket than at a portion that enclose the side wall 711 of the second bracket. The mass 750*a* may have the center of gravity such that the drum 300 in which laundry has been accommodated is not inclined to one side, or serves as a mass when the drum 300 vibrates.

Figure 8:
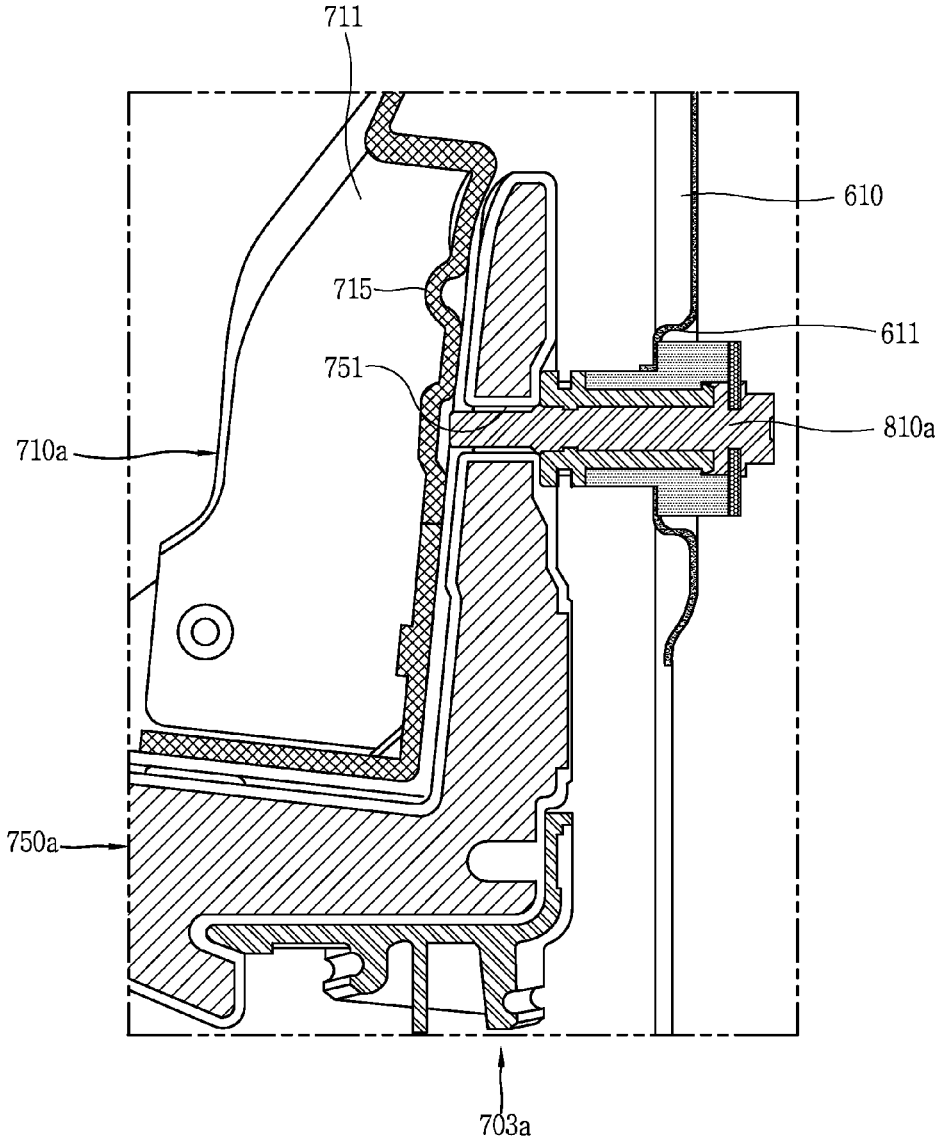
FIG. 8 is a side sectional view, taken along line VII-VII of FIG. 4.

Referring to FIG. 8, the mass 750*a* may be further provided with a through hole 751 to fix the mass 750*a* to a rear surface 610 of the cabinet 80 by, for example, a transit bolt 810*a*. The transit bolt 810*a* may extend from a bolt mounting portion 611 formed at the rear surface 610 of the cabinet 80, toward the mass 750*a*. One end of the transit bolt 810*a* may be inserted into the through hole 751. The rear spring holder 703*a* to fix the rear elastic member 720*a* may be fixed to a lower surface of the mass 750*a* by, for example, a bolt.

The rear spring holder 703*a* may be provided with a through hole to be coupled with the mass 750*a* by, for example, a bolt. Further, the rear spring holder 703*a* may have an upper portion having one end bent upward according to a shape of the lower surface of the mass 750*a*, and a lower portion having a screw thread on an outer surface thereof. The screw thread may receive fittedly-inserted therein the rear elastic member 720*a*. The lower portion of the rear spring holder 703*a* may have a same shape as a shape of the aforementioned front spring holder 701*a*, and thus, detailed explanations thereof has been omitted.

Figure 9:
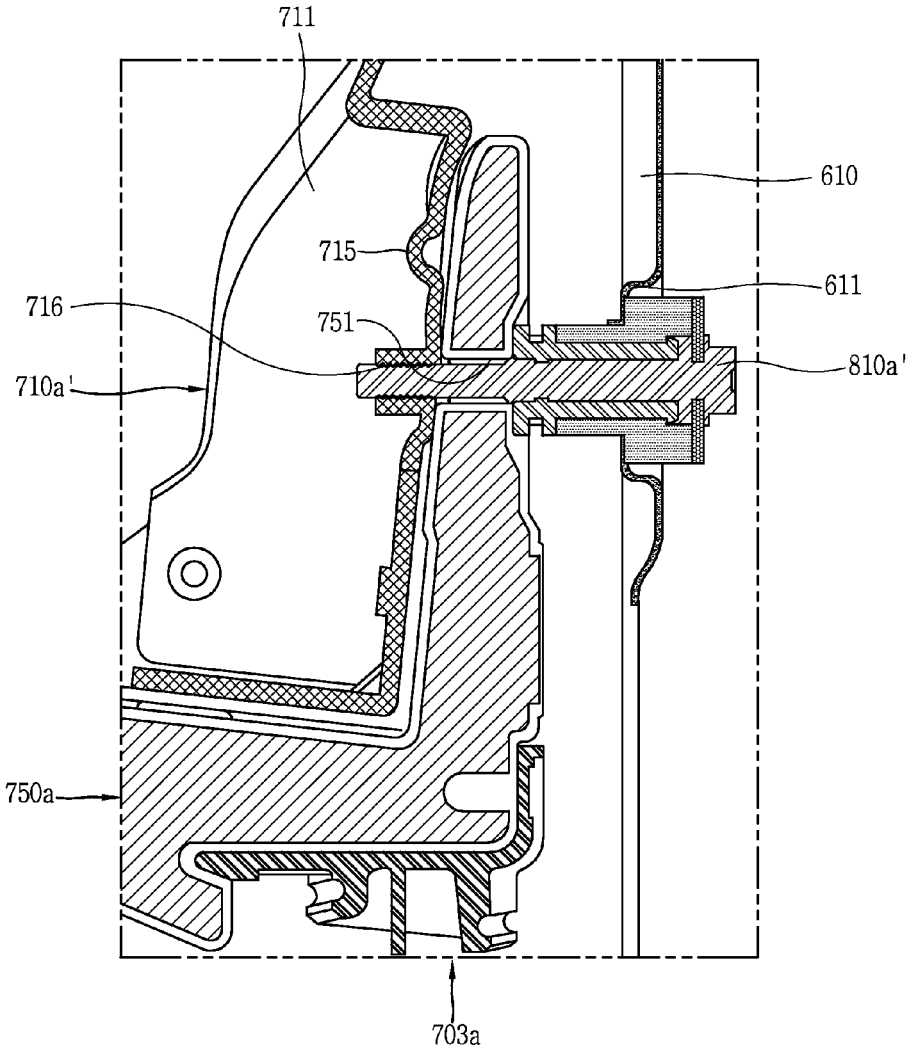
FIG. 9 is a side sectional view illustrating a first bracket connected to a mass and a cabinet, according to another embodiment.

FIG. 9 is a side sectional view illustrating a first bracket 710*a*' and a transit bolt 810*a*' coupled to a mass 750*a* according to another embodiment. Referring to FIG. 9, the first bracket 710*a*' may further include a bolt coupling portion 716 having a screw thread on an inner surface thereof. The screw thread may screw-couple one end of the transit bolt 810*a*' to the first bracket 710*a*'. The transit bolt 810*a*' may extend from the rear surface 610 of the cabinet 80, by passing through the through hole 751 of the mass 750*a*. One end of the transit bolt 810*a*' may be screw-coupled to the bolt coupling portion 716 of the first bracket 710*a*'. In the embodiment of FIG. 8, the transit bolt 810*a* may be connected to the mass 750*a*. However, in the embodiment of FIG. 9, the transit bolt 810*a* may be connected to the first bracket 710*a*, as well as the mass 750*a*. Accordingly, a supporting force may be enhanced.

As the plurality of dampers, any dampers may be used to provide a damping force due to a frictional resistance generated when a piston is moved in a cylinder. The plurality of dampers may include a pair of first dampers 760*a*, 760*b* to reduce vibration generated by the drum 300 in right and left directions or a lateral direction, a pair of second dampers 770*a*, 770*b* to reduce vibration generated when the drum 300 is rotated, and a pair of third dampers 780*a*, 780*b* to reduce vibration generated by the drum 300 in upper and lower directions or a vertical direction.

The pair of first dampers 760*a*, 760*b* may be disposed at the drum 300, in a symmetrical manner to each other based on the rotational shaft 351 of the drum 300. More specifically, the first damper 760*a* may be provided on the left or a first side of the drum 300, whereas the first damper 760*b* may be provided on the right or a second side of the drum 300. Likewise, the pair of second dampers 770*a*, 770*b* may be disposed at the drum 300, in a symmetrical manner to each other based on the rotational shaft 351 of the drum 300. Likewise, the pair of third dampers 780*a*, 780*b* may be disposed at the drum 300, in a symmetrical manner to each other based on the rotational shaft 351 of the drum 300. Hereinafter, the plurality of dampers 760*a*, 770*a*, 780*a* disposed on the left side of the drum 300 will be explained.

The first damper 760*a* may reduce vibration generated from the drum 300 in the lateral direction. The first damper 760*a* may extend from the front end portion of the second bracket 730*a* to the base 600, toward the inner side of the cabinet 80, with a downward inclination. The first damper 760*a* may be installed between the front elastic member 740*a* and the second damper 770*a*, and the end portion of the first damper 760*a* connected to the second bracket 730*a* may be adjacent to the front elastic member 740*a*.

The first damper 760*a* may be arranged substantially in parallel to a widthwise direction (diameter direction) of the drum 300, and a first angle ($\theta_1$) between the first damper 760*a* and the base 600 may be about 30°. However, the first angle ($\theta_1$) is not limited to this angle, and may be within a range of 30°~60°. In a case in which the third damper 780*a*, which is discussed hereinbelow, is further provided, the first angle ($\theta_1$) may be determined within a range smaller than a third angle ($\theta_3$) between the third damper 780*a* and the base 600.

The first damper 760*a* may have a smaller damping force than the second damper 770*a*, which is discussed hereinbelow. For example, the first damper 760*a* may have a damping force of about 40N. In a case in which the third damper 780*a* is further provided, the first damper 760*a* may have the same damping force as the third damper 780*a*.

The second damper 770*a* may reduce vibration generated when the drum 300 is consecutively rotated. The second damper 770*a* may extend with an inclination, from the central portion of the second bracket 730*a*, to the base 600, toward the rear side of the cabinet 80. The second damper 770*a* may extend in a lengthwise direction (shaft direction) of the drum 300, or in the rear to front direction of the cabinet 80. The second damper 770*a* may be provided between the first damper 760*a* and the rear surface 610 of the cabinet 80. The rear surface 610 of the cabinet 80 is illustrated in FIGS. 7 and 8. More specifically, the end portion of the second damper 770*a* hinge-connected to the second bracket 730*a* may be disposed adjacent to the first damper 760*a*, and the end portion of the second damper 770*a* hinge-connected to the base 600 may be disposed adjacent to the rear elastic member 720*a*.

A second angle ($\theta_2$) between the second damper 770*a* and the base 600 may be the same as the first angle ($\theta_1$). The second damper 770*a* may have a larger damping force than the first damper 760*a*. The second damper 770*a* may be formed to have a larger damping force than the first damper 760*a*, within a range of about 40N~80N. For example, the second damper 770*a* may be formed to have a damping force of about 80N. As the second damper 770*a* has a larger damping force than the first damper 760*a*, vibration transmitted to the base 600 may be significantly reduced, and vibration of ball balancers may be reduced.

According to one embodiment, the third damper 780*a* may be further included. The third damper 780*a* may reduce vibration generated by the drum 300 in upper and lower directions or a vertical direction. The third damper 780*a* may extend from the first bracket 710*a* toward the base 600, with an inclination. The end portion of the third damper 780*a* hinge-connected to the base 600 may be adjacent to the rear elastic member 720*a*.

Figure 15:
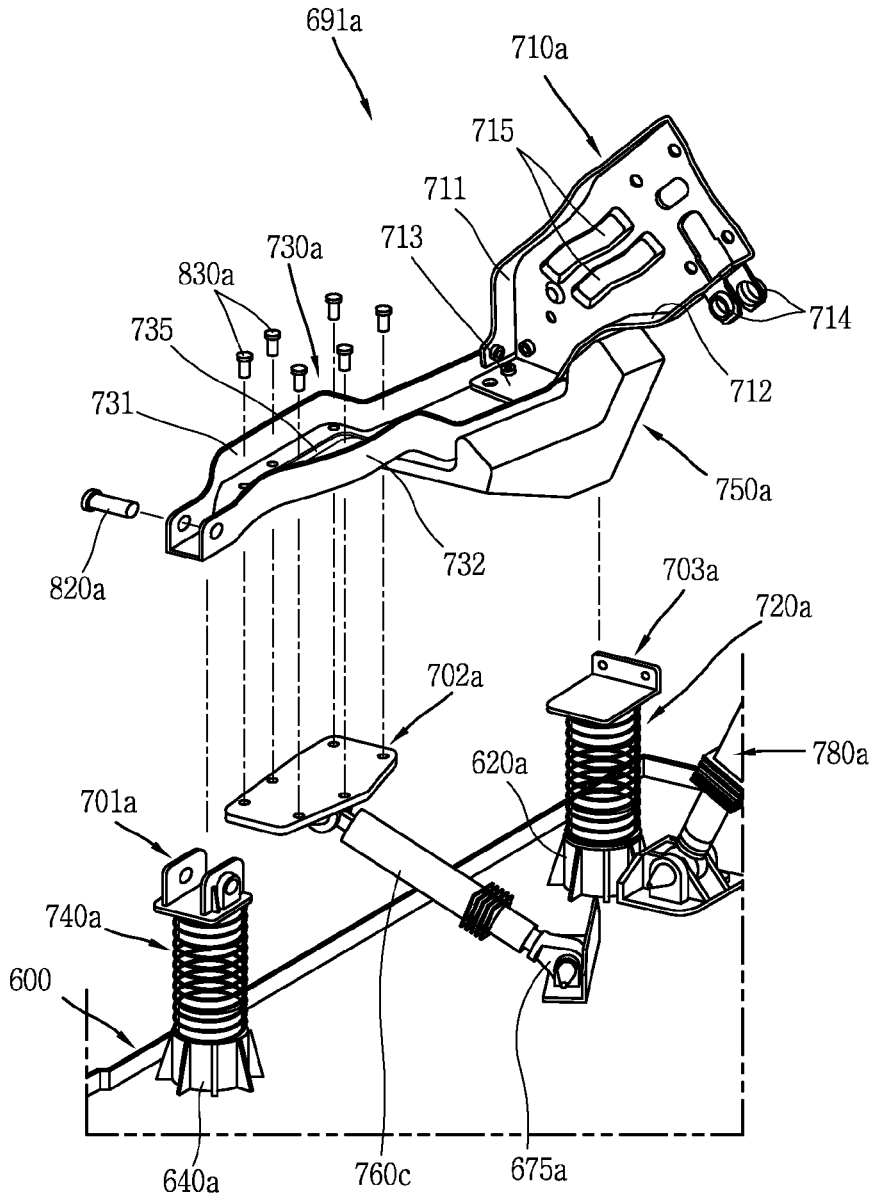
FIG. 15 is a disassembled perspective view corresponding to FIG. 6, which illustrates a damper holder to which a horizontal damper has been coupled, coupled to a support according to another embodiment.

A third angle ($\theta_3$) between the third damper 780*a* and the base 600 may be about 65°. The third damper 780*a* may be formed to have a smaller damping force than the second damper 770*a*. The third damper 780*a* may have a same damping force as the first damper 760*a*. For example, the third damper 780*a* may be formed to have a damping force of about 40N. For example, as shown in FIG. 15, the support 690 (first support 691*a*) may be supported by a single horizontal damper 760*c*.

The base 600 may be provided with a lower end fixing portion 675*a* to fix a lower end of the horizontal damper 760*c*. The horizontal damper 760*c* may be inclined with a predetermined first angle (θ1) in the lateral direction of the cabinet 80, and may be inclined with a second angle (θ2) in the rear to front direction of the cabinet 80. The first angle (θ1) and the second angle (θ2) may be about 45°, for example. That is, the horizontal damper 760*c* may be disposed with an inclination angle of about 45° in the lateral direction of the cabinet 80, and may be disposed with an inclination angle of 45° in the rear to front direction of the cabinet 80. With such a configuration, the horizontal damper 760*c* may attenuate vibration of the support 691*a* in the lateral direction of the cabinet 80, and may attenuate vibration of the support 691*a* in the rear to front direction of the cabinet 80.

In this embodiment, the first angle (θ1) and the second angle (θ2) are about 45°, respectively. However, the first angle (θ1) and the second angle (θ2) may be properly controlled with consideration of vibration characteristics of the tub 90.

Figure 16:
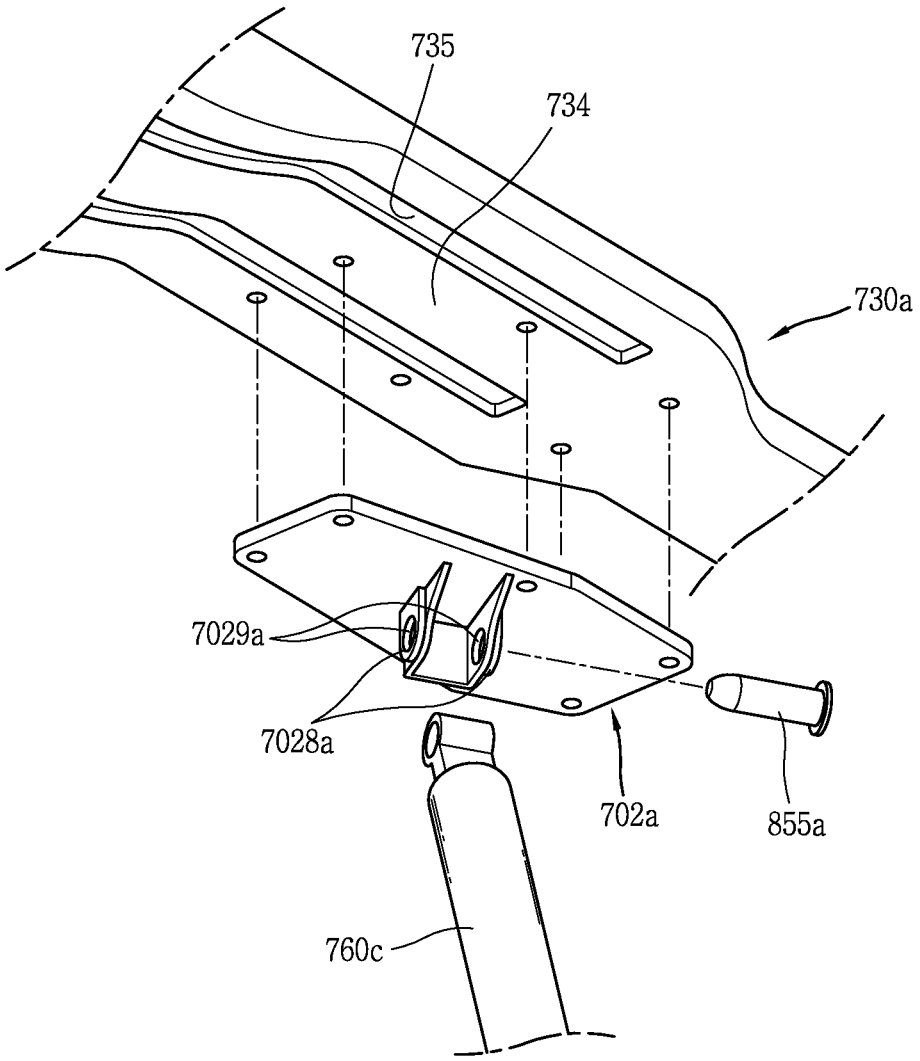
FIG. 16 is a bottom perspective view before the horizontal damper and the damper holder of FIG. 15 are coupled to each other.

The base 600 may be provided with a lower end fixing portion 675*a* to fix a lower end of the horizontal damper 760*c*. For example, as shown in FIG. 16, a horizontal damper connection portion 7028*a* to couple an upper end of the horizontal damper 760*c* may be formed at a bottom surface of the damper holder 702*a*. The horizontal damper connection portion 7028*a* may be inclined with a predetermined angle in a rear to front direction of the damper holder 702*a*.

In this embodiment, as the damper holder 702*a* is arranged in the rear to front direction of the cabinet 80, the horizontal damper connection portion 7028*a* may be formed with an inclination angle of about 45° with respect to the damper holder 702*a*. Through holes 7029*a* to insert a horizontal damper pin 855*a* may be formed at the horizontal damper connection portion 7028*a*.

Hereinafter, a method of manufacturing a clothes treating apparatus will be explained in more detail with reference to FIGS. 2 to 16. A method of manufacturing a clothes treating apparatus according to an embodiment may include a suspension installation, step S10, and a tub-drum installation, step S20.

The suspension installation, step S10, may include manufacturing a support-bearing housing assembly, step S100, and a buffering member installation, step S200. The manufacturing the support-bearing housing assembly, step S100, and the buffering member installation, step S200, may be individually performed. Alternatively, the manufacturing the support-bearing housing assembly, step S100, and the buffering member installation, step 200, may be performed in a partial simultaneous manner. Alternatively, the suspension installation may be performed after the manufacturing of the support-bearing housing assembly.

The manufacturing of the support-bearing housing assembly, step S100, may include support manufacturing, step S110, and support-bearing housing coupling, step S130. In the support manufacturing, step S110, first brackets 710*a*, 710*b* and second brackets 730*a*, 730*b*, which each may be formed by press molding, may be prepared. Then, bent portions of the first brackets 710*a*, 710*b* may be coupled to rear ends of the second brackets 730*a*, 730*b* in a caulking manner, as discussed above. As a result, two supports 691*a*, 691*b* may be manufactured. The two supports 691*a*, 691*b* may be formed to have shapes symmetrical to each other based on rotational shaft 351 of drum 300.

In the support-bearing housing coupling, step S130, as the pair of supports 691*a*, 691*b* may be coupled to bracket connection portions 410*a*, 410*b* of the bearing housing 400, assembly of the supports 691*a*, 691*b* and the bearing housing 400 may be performed.

The buffering member installation, step S200, may include installing buffering members to reduce vibration of the drum 300, between the supports 691*a*, 691*b* and the base 600, respectively. The buffering member installation, step S200, may include buffering member arrangement, steps S210, S220, a buffering member holder arrangement, steps S230, S240, and a support arrangement, step S250. In the buffering member installation, step S200, each of buffering members, buffering member holders, and support may be installed right and left or laterally based on the rotational shaft 351 of the drum 300, with shapes symmetrical to each other. Hereinafter, a case in which the components are installed on the left of the drum 300 will be explained.

The buffering member arrangement, steps S210, S220, may include a damper arrangement, step S210, including coupling a plurality of dampers to the base 600, and an elastic member installation, step S220, including installing a plurality of elastic members to the base 600. In the damper arrangement, step S210, one end of each of the first dampers 760*a*, 760*b* may be hinge-coupled to the first damper fixing portions 660*a*, 660*b*, and one end of each of the second dampers 770*a*, 770*b* may be hinge-coupled to the second damper fixing portions 670*a*, 670*b*. In this case, the first damper pins 840*a* may be inserted into the first dampers 760*a*, 760*b*, such that the first dampers 760*a*, 760*b* have coupling shafts that extend in the front to rear direction of the cabinet 80. The second damper pins 850*a* may be inserted into the second dampers 770*a*, 770*b*, such that the second dampers 770*a*, 770*b* have coupling shafts that extend in the lateral direction of the cabinet 80.

In the elastic member installation, step S220, the plurality of elastic members 720*a*, 720*b*, 740*a*, 740*b* may be fixed to the base 600. More specifically, the elastic members may be installed in the vertical direction, and one end of each of the elastic members may be insertion-fixed to the plurality of elastic member fixing portions 620*a*, 620*b*, 640*a*, 640*b* formed at the base 600.

Figure 12:
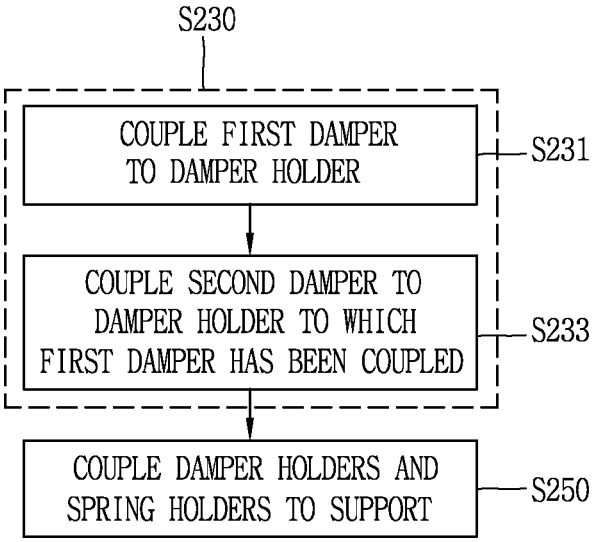
FIG. 12 is a flowchart illustrating a damper holder arrangement of FIG. 11 according to an embodiment.

The buffering member holder arrangement, steps S230, S240, may include a damper holder arrangement, step S230, including coupling the first and second dampers 760*a*, 770*a* to the damper holders, and a spring holder installation, step S240, including installing the spring holders 701*a*, 703*a* to the elastic members 720*a*, 720*b*, 740*a*, 740*b*. Referring to FIG. 12, the damper holder arrangement, step S230, may include a first damper coupling, step S231, and a second damper coupling, step S233.

In the first damper coupling, step S231, as discussed above, the first damper 760*a* may be coupled to the first damper connection portion 7023*a* of the damper holder 702*a*. As shown in FIG. 7, the first damper pin 840*a* to connect the first damper connection portion 7023*a* to the first damper 760*a* may be inserted to the front side from the rear side of the cabinet 80. As a result, the damper holder 702*a* and the coupling shaft of the first damper 760*a* may be coupled to each other so as to extend in the rear to front direction of the cabinet 80. Further, the first damper 760*a* may be arranged to extend to the base 600 from the damper holder 702*a*, toward the inner side of the cabinet 80.

In the second damper coupling, step S233, the second damper 770*a* may be coupled to the second damper connection portion 7027*a* of the damper holder 702*a* to which the first damper 760*a* has been coupled. As shown in FIG. 7, the second damper pin 850*a* to connect the second damper connection portion 7027*a* to the second damper 770*a* may be inserted to the inner side from the lateral side of the cabinet 80. As a result, the damper holder 702*a* and the coupling shaft of the second damper 770*a* may be coupled to each other so as to extend in the lateral direction of the cabinet 80. Further, the second damper 770*a* may be arranged to extend to the base 600 from the damper holder 702*a*, toward the rear side of the cabinet 80.

With such a configuration, when the damper pins 840*a*, 850*a* are coupled to the first damper connection portion 7023*a* and the second damper connection portion 7027*a* arranged in the damper holder 702*a* with a small gap therebetween, respectively, assembly of the first damper pin 840*a* may not interfere with the second damper pin 850*a*.

As discussed above with reference to FIG. 7, the first damper pin 840*a* may be inserted into the through holes 7026*a*, and the second damper pin 850*a* may be inserted into the through holes 7024*a*. Referring to FIG. 7, only the first damper pin 840*a* and the second damper pin 850*a* are installed on the left side of the drum 300. However, a first damper pin and a second damper pin may be installed on the right side of the drum 300, in a symmetric manner to the first damper pin 840*a* and the second damper pin 850*a* on the left.

In the support arrangement, step S250, the support 690 may be arranged such that the damper holder mounting portion 734 of the support 690 faces the plate 7021*a* of the damper holder 702*a*. Further, the support 690 may be arranged such that its front end portion corresponds to the front spring holder 701*a*, and its lowest portion (bent portion) corresponds to the rear spring holder 703*a* at the rear side of the cabinet 80. In this case, the support 690 may be arranged so that its lowest portion is lower than the coupling shaft of the first damper 760*a* coupled to the damper holder 702*a*, and the coupling shaft of the second damper 770*a* coupled to the damper holder 702*a*. The front end portion of the support 690 may be coupled to the front spring holder 701*a* by, for example, a bolt, and the bent portion of the support 690 may be coupled to the rear spring holder 703*a* by, for example, a bolt. The damper holder mounting portion 734 of the support 690 may be coupled to the damper holder 702*a*, as the plurality of coupling screws 830*a* may be inserted into the through holes 7022*a* of the plate 7021*a* by passing through the damper holder mounting portion 737. That is, as shown in FIG. 6, the plurality of coupling screws 830*a* may be inserted into the through holes 7022*a* from an upper side of the support 690.

With such a configuration, the first damper 760*a* may be first coupled to the damper holder 702*a*. Then, the support 690, which has a lowest end lower than the coupling shaft of the first damper 760*a* coupled to the damper holder 702*a*, may be coupled to the damper holder 702*a*. Accordingly, assembly of the first damper pin 840*a* may not interfere with the lowest portion of the support 690. Further, as the coupling screws 830*a* may be inserted into the through holes 7022*a* from the upper side of the support 690, assembly between the support 690 and the damper holder 702*a* may be facilitated.

In the damper holder arrangement discussed above, the first damper 760*a* and the second damper 770*a* may be coupled to a single damper holder 702*a*. However, the clothes treating apparatus is not so limited; that is, as with respect to FIGS. 15 to 17, one horizontal damper may be coupled to one damper holder. In another embodiment, a damper holder, to which the first damper 760*a* may be coupled, and a damper holder, to which the second damper 770*a* may be coupled, may be formed as separate members, as discussed above.

Figure 13:
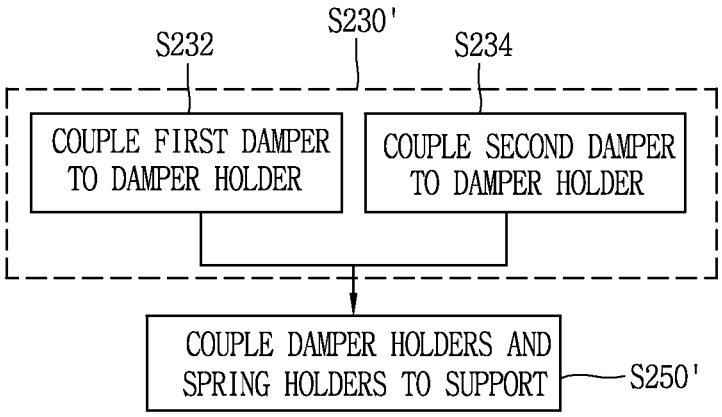
FIG. 13 is a flowchart illustrating a damper holder arrangement of FIG. 11 according to another embodiment.

FIG. 13 is a flowchart illustrating a damper holder arrangement, step S230', and a support arrangement, step S250', according to another embodiment. The damper holder arrangement, step S230', according to this embodiment may include coupling the first damper 760*a* to one damper holder, step S232, and coupling the second damper 770*a* to another damper holder, step S234. In this case, the first damper 760*a* and the second damper 770*a* may be assembled to the damper holders, because one damper is coupled to one damper holder. Accordingly, one of the first damper coupling, step S232, and the second damper coupling, step S234, may be performed first. Alternatively, the first damper coupling, step S232, and the second damper coupling, step S243, may be simultaneously performed. In the first damper coupling, step S232, a damper pin may be inserted to the front side from the rear side of the cabinet 80, such that the coupling shaft of the first damper 760*a* may extend in the rear and front direction of the cabinet 80. In the second damper coupling, step S234, a damper pin may be inserted to the inner side from the lateral side of the cabinet 80, such that the coupling shaft of the second damper 770*a* extends in the lateral direction of the cabinet 80.

Referring to FIG. 13, in the supporting member arrangement, step S250', according to another embodiment, the damper holders may be coupled to the damper holder mounting portions 734 of the support 690. The damper holder, to which the first damper 760*a* has been coupled, and the damper holder, to which the second damper 770*a* has been coupled, may be separate members. Accordingly, the first damper 760*a* may be arranged to extend from the damper holder to the base 600 toward the inner side of the cabinet 80, and the second damper 770*a* may be arranged to extend from the damper holder to the base 600 toward the rear side of the cabinet 80. Repetitive explanations the same as the aforementioned explanations have been omitted.

With such a configuration, the first damper 760*a* and the second damper 770*a* may be installed at the support 690 without interfering with the lowest end of the support 690. The first damper pin 840*a* may be inserted into the cabinet 80 from the rear side of the cabinet 80, to thus be coupled to the first damper 760*a* and the damper holder 702*a*. Accordingly, if the support 690 is first arranged, assembly of the first damper pin 840*a* may interfere with the lowest end of the support 690. However, with the above discussed configuration, assembly may be implemented without such interference.

In such a manner, the suspensions may be laterally installed at the rotational shaft 351 of the drum 300, so as to be symmetric to each other. In step S20 of installing the tub 90 and the drum 300, the tub 90 may be fixed to the base 600, and the drum 300 may be rotatably installed at the tub 90.

Figure 10:
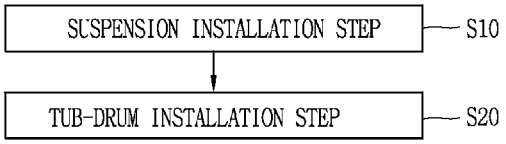
FIG. 10 is a flowchart illustrating a method of manufacturing a clothes treating apparatus according to an embodiment.
Figure 11:
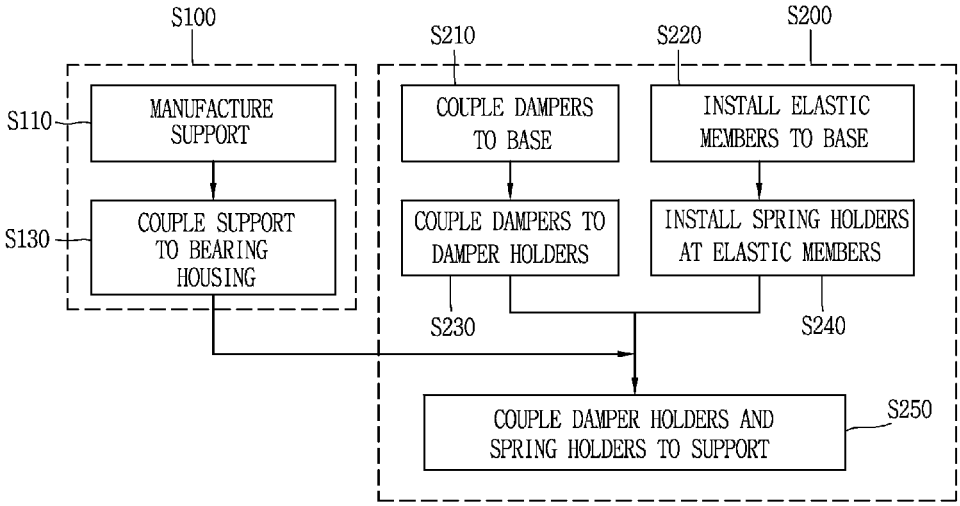
FIG. 11 is a flowchart illustrating a suspension installation of FIG. 10 according to an embodiment.
Figure 14:
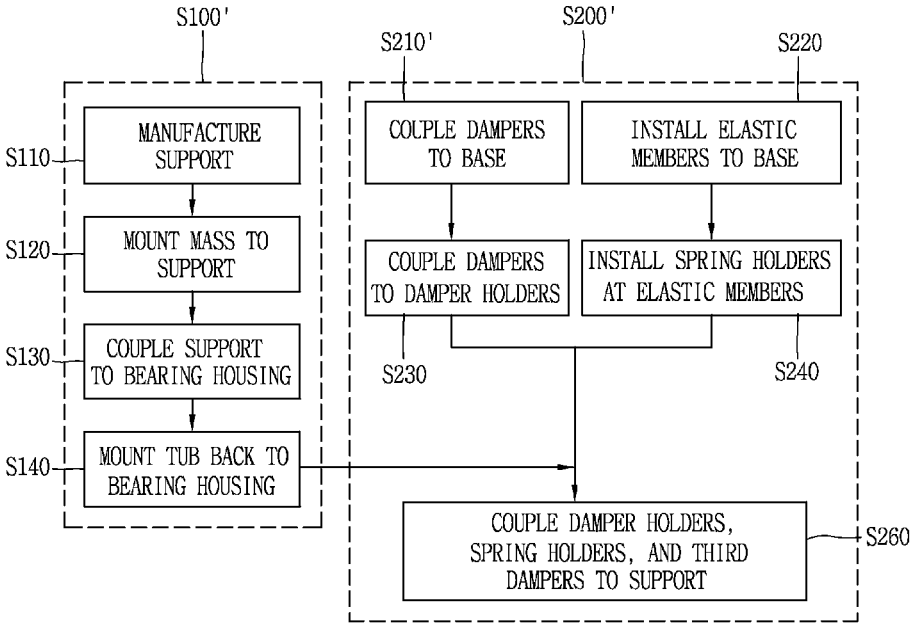
FIG. 14 is a flowchart illustrating a suspension installation of FIG. 10 according to another embodiment.

FIG. 14 is a flowchart illustrating another embodiment of a suspension installation of FIG. 10. Referring to FIG. 14, a support-bearing housing coupling, step S100', according to another embodiment may further include a mass mounting, step S120, and a tub back mounting, step S140. In the mass mounting, step S120, the above discussed masses 750*a*, 750*b* may be mounted to the bent portions of the supports 691*a*, 691*b*, that is, a connected portion between the first brackets 710*a*, 710*b* and the second brackets 730*a*, 730*b*. Then, the supports 691*a*, 691*b* where the masses 750*a*, 750*b* have been installed may be coupled to the bracket connection portions 410*a*, 410*b* of the bearing housing 400. As a result, assembly of the supports 691*a*, 691*b* and the bearing housing 400 may be manufactured. In the tub back mounting, step S140, the tub back 130 may be mounted to a front surface of the bearing housing 400. In this case, the tub back 130 having the rear gasket 250 on an outer circumference thereof may be mounted.

Referring to FIG. 14, a buffering member installation, step S200', according to another embodiment may include a buffering member arrangement, steps S210', S220, a buffering member holder arrangement, steps S230, S240, and a support arrangement, step S260. In the buffering member installation, step S200', buffering members, buffering member holders, and supports may be latterly installed, based on the rotational shaft 351 of the drum 300, with shapes symmetrical to each other. Hereinafter, a case in which the components are installed on the left side of the drum 300 will be explained.

The buffering member arrangement may include a damper arrangement, step S210', and an elastic member installation, step S220. The elastic member installation, step S220, will not be explained, because it has been discussed above. In the damper installation, step S210', third dampers may be further installed. The third dampers 780*a*, 780*b* may be hinge-coupled to the third damper fixing portions 680*a* of the base 600, such that coupling shafts thereof extend in the rear to front direction of the cabinet 80.

The buffering member holder arrangement, steps S230, S240 may be the same as those of the previous embodiment, and thus, repetitive explanation has been omitted.

Referring to FIG. 6, in the support arrangement, step S260, the rear spring holder 703*a* may be coupled to the mass 750*a*. The third damper 780*a* may be hinge-coupled to the damper coupling portion 714 of the first bracket 710*b*. More specifically, the third damper 780*a* may extend from the damper coupling portion 714 to the base 600, with an inclination with respect to the lateral side of the cabinet 80. The third damper 780*a* may be coupled to the damper coupling portion 714, such that its coupling shaft extends in the lateral direction of the cabinet 80. In this case, third damper pins may be inserted to the front side of the cabinet 80 from the rear side of the cabinet 80.

As aforementioned, according to an embodiment, when a plurality of buffering members to attenuate vibration of the drum 300 are installed between a bottom surface of the cabinet 80 and the support 690, the buffering members may be connected to the support 690 without interfering with the lowest end of the support 690. According to embodiments, even if two or more buffering members are coupled to one buffering member holder, the buffering members and the buffering member holder may not interfere with each other.

Embodiments disclosed herein provide a clothes treating apparatus not requiring a buffering member installed at a tub for reduction of vibration, by preventing vibration generated from a driving unit or drive and a drum from being transmitted to the tub, and a method for manufacturing the same.

Embodiments disclosed herein further provide a clothes treating apparatus capable of installing a plurality of dampers between a bottom surface of a cabinet and a supporting member or support, without interference with a lowest part or portion of the supporting member, and a method for manufacturing the same.

Embodiments disclosed herein provide a clothes treating apparatus capable of preventing interference among a plurality of dampers when coupling the plurality of dampers to a single damper holder, and a method for manufacturing the same.

Embodiments disclosed herein provide a clothes treating apparatus that may include a cabinet; a tub disposed in the cabinet; a drum rotatably accommodated in the tub; a supporting member or support having one or a first side connected to a rear side of the tub, and another or a second side that extends downward and is bent forward; a damper having a lower end connected to a bottom surface of the cabinet; and a damper holder installed between the damper and the supporting member, and configured to connect the damper to the supporting member. The supporting member may be disposed such that a height of a lowest end thereof is lower than a height of a coupling shaft of the damper coupled to the damper holder.

The damper may include a first damper having a coupling shaft that extends in right and left directions or a lateral direction of the cabinet, and a second damper having a coupling shaft that extends in a rear and front direction of the cabinet. The coupling shaft of the first damper may be configured to be inserted into the damper holder and the damper, from a rear side to a front side of the cabinet, in the rear and front direction of the cabinet. The lowest end of the supporting member may be configured as a bent portion disposed at a rear region of the cabinet.

The first damper may be installed to extend from the damper holder to a bottom surface of the cabinet, toward an inner side of the cabinet. The second damper may be installed to extend from the damper holder to a bottom surface of the cabinet, toward a rear side of the cabinet.

The damper may further include a third damper coupled to the supporting member. The third damper may be installed to extend downward from the supporting member to a bottom surface of the cabinet, toward a lateral side of the cabinet.

A damper holder mounting portion to mount the damper holder may be provided on a bottom surface of the supporting member. The clothes treating apparatus may further be provided with a coupling member coupled to the damper holder by passing through the supporting member from an upper side of the supporting member.

The supporting member may be provided at lower two sides of the tub, respectively, in the right and left directions of the cabinet. The clothes treating apparatus may further include a bearing housing coupled to both of the supporting members disposed at the lower two sides of the tub.

The clothes treating apparatus may further include a mass coupled to the lowest end of the supporting member.

Embodiments disclosed herein further provide a clothes treating apparatus that may include a cabinet; a tub disposed in the cabinet; a drum rotatably accommodated in the tub; a supporting member or support having one or a first side connected to a rear side of the tub, and another or a second side that extends downward and then is bent forward; a first damper having a lower end connected to a bottom surface of the cabinet, and having a coupling shaft disposed in a rear and front direction of the cabinet; a second damper having a lower end connected to a bottom surface of the cabinet, and having a coupling shaft disposed in right and left directions or a lateral direction of the cabinet; and a damper holder installed between the first and second dampers and the supporting member, and configured to connect the first and second dampers to the supporting member. The supporting member may be disposed such that a height of a lowest end thereof is lower than a height of the coupling shafts of the first and second dampers coupled to the damper holder.

Embodiments disclosed herein further provide a method of manufacturing a clothes treating apparatus. The method may include a buffering member installation step of installing a buffering member to attenuate vibration of a drum, between a bottom surface of a cabinet of the clothes treating apparatus and a supporting member or support. The buffering member installation step may include a damper installation step of installing a damper having a lower end connected to a bottom surface of the cabinet; a damper holder arrangement step of coupling an upper end of the damper to a damper holder; and a supporting member arrangement step of arranging the supporting member such that a height of a lowest end thereof is lower than a height of a coupling shaft of the damper coupled to the damper holder.

The damper may include a first damper and a second damper. The damper holder arrangement step may include a first damper coupling step of coupling the first damper to a damper holder such that the first damper has a coupling shaft that extends in a rear to front direction of the cabinet; and a second damper coupling step of coupling the second damper to the damper holder such that the second damper has a coupling shaft that extends in right and left directions or lateral direction of the cabinet.

In the first damper coupling step, the first damper may be coupled to the damper holder as the coupling shaft may be inserted from a rear side to a front side of the cabinet. In the supporting member arrangement step, the lowest end of the supporting member may be disposed at a rear side of the cabinet, the first damper may be arranged to extend from the damper holder to a bottom surface of the cabinet, toward an inner side of the cabinet and the second damper may be arranged to extend from the damper holder to a bottom surface of the cabinet, toward a rear side of the cabinet.

The buffering member installation step may further include a third damper coupling step of coupling a third damper to the supporting member, after the supporting member arrangement step. In the third damper coupling step, the third damper may be arranged to extend downward from the supporting member to a bottom surface of the cabinet, toward a lateral side of the cabinet, in the right and left directions of the cabinet.

In the supporting member arrangement step, the damper holder may be coupled to a lower surface of the supporting member, and a coupling member may be configured to be inserted into the damper holder by passing through the supporting member.

The method of manufacturing a clothes treating apparatus may further include a step of manufacturing a supporting member-bearing housing assembly including a bearing housing coupling step of coupling a plurality of supporting members or supports to a bearing housing right and left in a symmetrical manner. In the supporting member arrangement step, each supporting member may be coupled to the damper holder, after being coupled to the bearing housing.

The step of manufacturing a supporting member-bearing housing assembly may further include a mass coupling step of coupling a mass to a lowest end of the supporting member.

Further scope of applicability will become more apparent from the detailed description given hereinafter. However, it should be understood that the detailed description and specific examples, while indicating embodiments, are given by way of illustration only, since various changes and modifications within the spirit and scope will become apparent to those skilled in the art from the detailed description.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A clothes treating apparatus, comprising:

a cabinet;

a tub disposed in the cabinet;

a drum rotatably accommodated in the tub;

a bearing house coupled to a rear surface of the tub;

a plurality of supports connected to the bearing house, each having a first bracket extending from the bearing house in a downward direction and a second bracket extending from the first bracket toward a front side of the cabinet;

a plurality of dampers, each having a lower end connected to a bottom surface of the cabinet;

a plurality of first elastic members, each supporting a front end of a respective second bracket;

a plurality of second elastic members, each supporting a rear end of a respective second bracket; and a plurality of damper holders installed between the plurality of dampers and the second brackets of the plurality of supports, respectively, to connect the plurality of dampers to the second brackets of the plurality of supports, wherein each of the plurality of the supports is disposed such that a height of a lowest portion thereof is lower than a height of a damper pin of a respective damper coupled to the respective damper holder, wherein each set of the plurality of dampers includes a first damper extending from the respective damper holder toward an inner side of the cabinet and having a first damper pin that extends in a rearward to frontward direction of the cabinet, a second damper extending from the respective damper holder toward a rear side of the cabinet and having a second damper pin that extends in a lateral direction of the cabinet, and a third damper coupled to a respective first bracket, and wherein each of the plurality of damper holders holds the first and second dampers.

2. The clothes treating apparatus of claim 1, wherein the first damper pin of each first damper is configured to be inserted into the respective damper holder and the respective first damper, in the rearward to frontward direction of the cabinet, and wherein the lowest portion of each support is configured as a bent portion disposed at the rear portion of the cabinet.

3. The clothes treating apparatus of claim 1, wherein the third damper is installed so as to extend in a downward direction from the respective first bracket to the bottom surface of the cabinet, toward a lateral side of the cabinet.

4. The clothes treating apparatus of claim 1, wherein a damper holder mount to mount the respective damper holder is provided on a bottom surface of each second bracket, and wherein a coupling member is coupled to the respective damper holder by passing through the respective second bracket from an upper side of the respective second bracket.

5. The clothes treating apparatus of claim 1, further comprising a mass coupled to the lowest portion of each support.

6. The clothes treating apparatus of claim 5, wherein the mass is made of concrete.

7. The clothes treating apparatus of claim 1, wherein the plurality of damper holders each has a first damper connection portion coupled to the first damper and a second damper connection portion coupled to the second damper, the first damper connection portion being provided closer to a lateral side of the cabinet than the second damper connection portion.

8. The clothes treating apparatus of claim 1, wherein the plurality of supports, the plurality of first, second, and third dampers, and the plurality of first and second elastic members are provided in a symmetrical manner, respectively, based on a rotational shaft of the drum.

* * * * *